US005431028A

United States Patent [19]

Lampert et al.

[11] Patent Number: 5,431,028

[45] Date of Patent: Jul. 11, 1995

[54] METAL JEWELRY ARTICLE HAVING ARTIFICIAL DIAMOND BAGUETTES FORMED THEREIN AND METHOD OF MANUFACTURING THEREOF

[76] Inventors: Dennis Lampert, 57 Cumberland, Lincolnshire, Ill. 60069; Jerry Madison, 9560 Cedarbrook Dr., Beverly Hills, Calif. 90210

[21] Appl. No.: 747,946

[22] Filed: Aug. 21, 1991

[51] Int. Cl.[6] ..... A44C 25/00; A44C 17/00

[52] U.S. Cl. ..... 63/2; 63/26; 63/28; 63/32

[58] Field of Search ..... 63/15, 2, 20, 26, 28, 63/32; D11/6, 34, 91, 92

[56] References Cited

U.S. PATENT DOCUMENTS

| | | | |
|---|---|---|---|
| D. 57,217 | 3/1921 | Eliasoff et al. | D11/92 |
| D. 152,469 | 1/1949 | Goodman | D11/92 |
| D. 245,489 | 8/1977 | Rimberg | D11/91 |
| D. 261,122 | 10/1981 | Barr | D11/34 |
| 1,544,367 | 6/1925 | Blaicher | 63/15 |
| 1,675,715 | 7/1928 | Liftin | 63/28 |
| 1,908,774 | 5/1933 | Maier | 63/32 |
| 2,121,201 | 6/1938 | Joyce | 63/15 |
| 2,246,399 | 6/1941 | Vastano et al. | 63/28 |
| 2,350,714 | 6/1944 | Bazner | 63/2 |
| 4,604,876 | 8/1986 | Hoffmann | 63/32 |

*Primary Examiner*—Michael J. Milano
*Attorney, Agent, or Firm*—Michael Best & Friedrich

[57] ABSTRACT

A metal jewelry article having one or more artificial diamond baguettes formed therein is disclosed. The jewelry article has a reflective metal surface with one or more concave indentations. Each of the concave indentations has a plurality of faceted reflective surfaces. The faceted reflective surfaces are angled and positioned so as to reflect light in a manner which simulates a diamond. As a result, the artificial diamond baguettes do not require polishing in the initial manufacturing process.

12 Claims, 3 Drawing Sheets

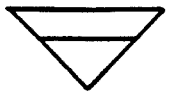
Fig. 6A
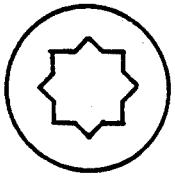
Fig. 6B
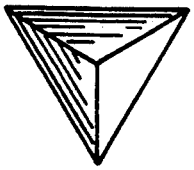
Fig. 6C
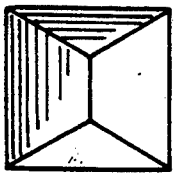
Fig. 6D
Fig. 7
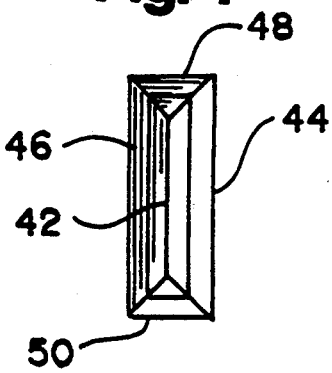
Fig. 9A
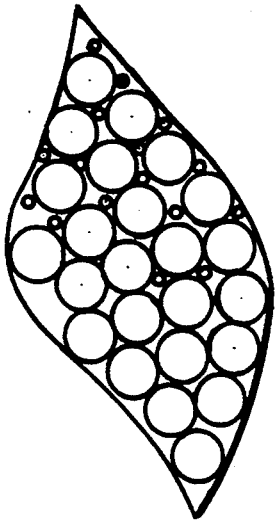
Fig. 8
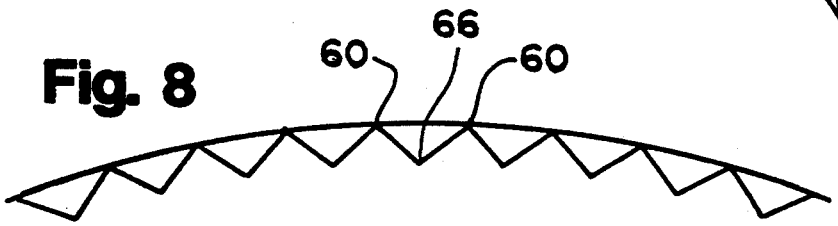
Fig. 9B
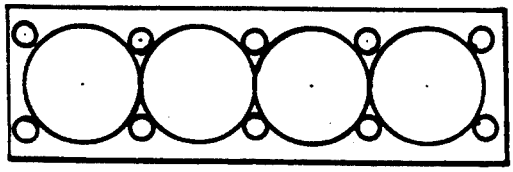
Fig. 10
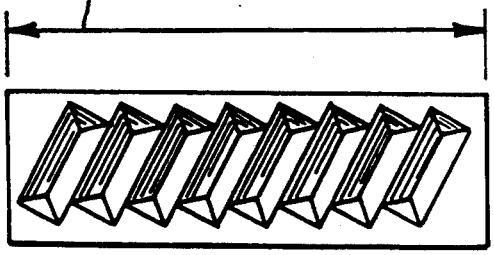

METAL JEWELRY ARTICLE HAVING ARTIFICIAL DIAMOND BAGUETTES FORMED THEREIN AND METHOD OF MANUFACTURING THEREOF

BACKGROUND OF THE INVENTION

The present invention relates generally to the production of imitation gems and more particularly to the manufacture of such jewelry having artificial diamond baguettes formed therein.

In the past, a number of jewelry articles have been disclosed having faceted surfaces. Examples include U.S. Design Pat. Nos. D054,976 Witstein; 055,597, Felger; 055,952, Mayer; 057,217, Elliasof et al.; 068,639, Robbins; 117,902, Keyep; 119,286, Sommers; 131,903, Roskin; 152,469, Goodman; and European Patent No. 0,311,487 A. Diamonts Joaialle. These patents generally disclose jewelry articles having faceted surfaces formed thereon.

In addition, U.S. Pat. No. 1,908,774 Maier, discloses a device for producing imitation gems in which marcasite stones are formed with a punch and die so as to have a convex surface which may be faceted and polished. However, marcasite stones are not useful in nor the most desireable gem in most jewelry applications. In addition, the imitation gems described in Maier must be polished on their exterior surface after formation.

Accordingly, it is an object of the present invention to provide jewelry articles having artificial gems formed therein during the original manufacturing process which are highly polished without requiring subsequent manufacturing steps.

It is an additional object of the present invention to provide metal jewelry articles having artificial diamond baguettes formed therein which resemble diamonds in their reflective appearance.

It is a further object of the present invention to provide a method and apparatus for forming such metal jewelry articles which is low in cost, easy to utilize and is capable of mass production of large quantities of such metal jewelry articles having artificial diamond baguettes formed therein.

SUMMARY OF THE INVENTION

In the present invention a novel metal jewelry article is disclosed having one or more artificial diamond baguettes formed therein. The article includes a reflective metal surface having one or more concave indentations formed therein. The indentations have a plurality of faceted reflective surfaces or corrugations. The faceted reflective surfaces are angled and positioned so as to reflect light in a manner which simulates a diamond. As a result a low cost jewelry article can be provided having a startlingly pleasing appearance.

In a preferred embodiment, the plurality of faceted reflective surfaces are formed in a substantially uniform rib and groove configuration having triangularly shaped end portions formed therein. The grooves in one embodiment are approximately 0.30 inches in width, 0.138 inches in length and 0.030 inches in depth. As a result of this size and configuration, light is reflected from the concave indentations in a manner which simulates a diamond. In this embodiment, the triangularly shaped end portions are 0.25 inches in height and 0.60 inches in length along their base. The metal jewelry article is 0.015 inches thick plus or minus 0.005 inches. Obviously the choice of metal and the size of the indentations and faceted surfaces may be changed to suit the desired end use and the invention is not limited thereto.

In the preferred embodiment the faceted reflective surfaces have side walls angled at approximately 45 degrees to each other. Preferable, each concave indentation is formed as a groove having a score line longitudinally bifurcating the groove. The jewelry articles are preferably formed of precious metals such as yellow gold, white gold, gold filled, silver or platinum.

In the preferred embodiment, the plurality of faceted reflective surfaces may include an exterior rectangle, an interior rectangle and a central longitudinal score line arranged so as to reflect light in a manner simulating a diamond. In an alternative embodiment, the rectangular concave indentation may be tapered so that the distal end of the indentation is wider than the proximal end thereby presenting the illusion of a tapered diamond. While a rectangular configuration is preferred, a round, triangular or trapezoidal configuration may also be utilized.

It has been unexpectedly found that concave indentations having facets formed therein reflect light in a manner which simulates a diamond baguette. This is in contrast to prior art artificial gems in which convex artificial gems are formed on the surface thereof. As a result of the present invention, a plurality of such artificial diamond baguettes may be disposed in a substantially linear array on the jewelry article. In an alternative embodiment, the artificial diamond baguettes may be round in shape and a plurality of them formed in what is known in the jewelry industry as pavé configuration. The pavé configuration resembles round paving stones on a cobble stone street.

A method of manufacturing metal jewelry articles using a punch and die is also disclosed. The method comprises the steps of placing the jewelry article on the die. The punch is then pressed downwardly on to the die with the jewelry article being contained therebetween. One or more concave indentations on the surface of the jewelry article are thereby formed. The concave indentations have a plurality of faceted reflected surfaces formed therein. The punch and die are beveled so as to form the facets. Similarly, the die may be formed with a series of ridges and grooves therein and at least one ridge on the punch. Preferably the ridges and grooves are formed at approximately a 45 degree angle to each other. A tool for forming the metal jewelry article of the present invention is also disclosed. The tool comprises a punch having one or more ridges formed thereon and a die having a series of ribs and grooves formed therein. The grooves are sized for mating engagement with the ridges of the punch. The ridges and grooves of the die are angled at approximately a 45 degree angle to each other. In a preferred embodiment the ribs and grooves are contained within a rectangular apature within the die.

BRIEF DESCRIPTION OF THE DRAWINGS

FIG. 6*a*–6*d* of the drawings are front elevational views of a number of alternative embodiments of artificial diamond baguettes for use in the jewelry article of FIG. 1 of the present invention.

FIG. 7 of the drawings is a front elevational view of an additional alternative embodiment of the artificial diamond baguettes of the jewelry article of FIG. 1 of the present invention.

FIG. 8 of the drawings is a side cut away view of an alternative embodiment of the die of FIG. 2.

FIG. 9*a* and 9*b* of the drawings are front elevational views of alternative embodiments of the artificial diamond baguettes of the jewelry article of FIG. 1 showing in particular a pavé arrangement of round baguettes.

FIGS. 10 and 11 are front elevational views of alternative arrangements of artificial diamond baguettes for the jewelry article of FIG. 1 of the drawings.

DETAILED DESCRIPTION OF THE PREFERRED EMBODIMENT

Figure 1:
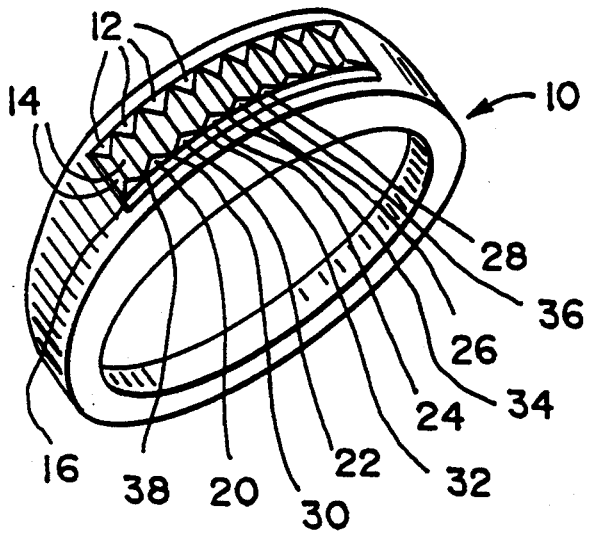
FIG. 1 of the drawings is a front perspective view of a metal jewelry article of the present invention having artificial diamond baguettes formed therein.

As is shown in the drawings and will herein be described in detail, there are several specific embodiments of the invention disclosed. However, the invention is not limited thereto except in so far as those who have the disclosure before them are able to make modifications and variations therein without departing from the scope of the invention.

Figure 1A:
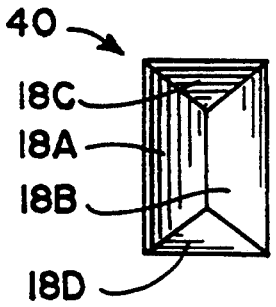
FIG. 1*a* of the drawings is a front elevational view of an artificial diamond baguette of the metal jewelry article of FIG. 1.

As shown in FIG. 1 of the drawings, a metal jewelry article 10 is disclosed having a series of artificial diamond baguettes 12 formed therein. Article 10 includes a reflective metal surface 14 having one or more concave indentations 16 formed therein. The concave indentations 16 each have a plurality of faceted reflective surfaces 18. The faceted reflective surfaces 18 are angled and positioned so as to reflect light in a manner which simulates a diamond. More specifically, as shown in FIG. 1A of the drawings, faceted reflective surfaces 18 comprise facet 18*a*, facet 18*b*, and triangular end portions 18*c* and 18*d*. When light strikes faceted surfaces 18 it is reflected against a second faceted surface and then outwardly. As a result a pure white light is presented to the user.

Figure 2:
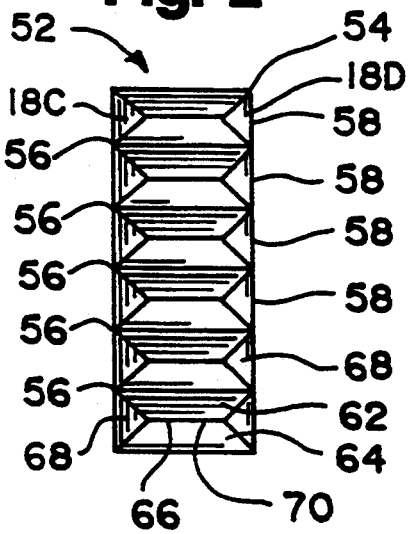
FIG. 2 of the drawings is a top view of a die used for forming the artificial diamond baguettes of the jewelry article of FIG. 1.
Figure 4:
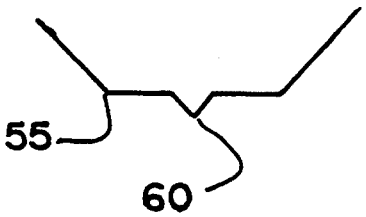
FIG. 4 of the drawings is a side cut away view of the die of FIG. 2.

As further shown in FIG. 1, faceted reflective surfaces 18 are formed as a series of grooves such as grooves 20, 22, 24, 26 and 28 and ribs 30, 32, 34, 36 and 38. In the embodiment shown, the grooves 20 through 28 are approximately 0.30 inches in width, 0.138 inches in length and 0.030 inches in depth. The triangularly shaped end portions 18*c* and 18*d* of, as shown in FIG. 2, are preferably 0.25 inches in height and 0.60 inches in length along their base, whereby the ribs and grooves reflect light in the manner described. In the embodiment shown, the jewelry article 10 is constructed of a precious metal which is 0.015±0.01 inches in thickness. Preferably, artificial metal jewelry article 10 is formed of yellow gold. However, alternative materials such as silver, white gold, gold filled, rhodium plating or platinum may also be utilized.

One of the key elements of the present invention is the angle of the faceted reflective surfaces 18. In a preferred embodiment the groove such as groove 20 have sidewalls 18*a* and 18*b* angled at an angle of approximately 45 degrees to each other. Similarly, the triangularly shaped end portions 18*c* and 18*d* are formed at an angle of approximately 45 degrees from rib 30. In the embodiment shown in FIG. 1*a*, artificial diamond baguette 40 has a longitudinal score line 42 bifurcating it. In addition, a triangularly shaped end portions 18*c* and 18*d* are formed in the shape of a right triangle.

It has been found that by reflecting light at approximately a 45 degree angle from precious metal surfaces, the reflected light appears white and is quite brilliant similar to that of a diamond.

Figure 5:
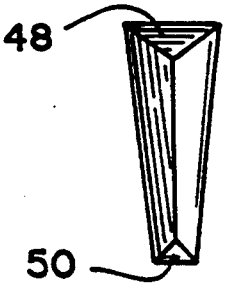
FIG. 5 of the drawings is a front elevational view of an alternative embodiment of an artificial diamond baguette for use on the jewelry article of FIG. 1 of the present invention.
Figure 3:
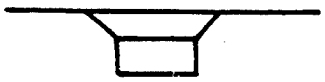
FIG. 3 of the drawings is a side view of a punch used in conjunction with the die of FIG. 2 for forming the artificial diamond baguettes of the metal jewelry article of FIG. 1 of the drawings.
Figure 11:
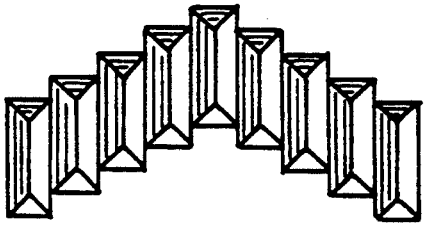

Turning to FIG. 7 of the drawings, in one embodiment, the concave indentations 16 may comprise an exterior rectangle 44, an interior rectangle 46 and a central longitudinal score line 42 arranged so as to reflect light in a manner simulating a diamond. Alternatively, as shown in FIG. 5, artificial diamond baguette 40 may be formed in a tapered configuration, whereby the distal end 48 of the artificial diamond baguette 40 is wider than the proximal end 50 thereof, so as to present the illusion of a tapered diamond. As shown in FIGS. 6A–6D, however, a number of alternative configurations may also be selected, including rectangular, round, triangular or trapezoidal. Preferably, however, the artificial diamond baguettes 40 may be arrayed in a substantially linear array, as shown in FIG. 1, or, as shown in FIG. 10, and may be angularly off set from each other or, linearly off set from each other.

As shown in FIGS. 9*a* and 9*b* of the drawings, the artificial diamond baguettes 40 of the present invention may be arranged in a pavé configuration in which round artificial diamond baguettes are disposed in juxtaposition to each other so as to resemble cobble stone paving.

The present invention further discloses a method of manufacturing the metal jewelry articles 10 of FIG. 1. As shown in FIG. 2, a metal die is disclosed for use in conjunction with a punch 55. Metal die 52 has a series of ridges 56 and die grooves 58 formed therein. A punch ridge 60 is formed on the surface of punch 55. Punch ridge 60 is sized for mating engagement with die grooves 58. As a result, when jewelry article 10 is placed between die 54 and punch 55, a single artificial diamond baguette 40 is formed by compressing the two together using a conventional mechanical punch press. Alternatively, as shown in FIG. 8, a plurality of punch ridges 60 may be provided so as to sequentially form a series of artificial diamond baguettes 40 along die 54. As shown in FIG. 2, die groove 58 contains a pair of faceted die surfaces 62 and 64 which are angled at approximately a 45 degree angle to each other. A score line 66 bifurcates the two faceted die surfaces 62 and 64. Preferably, as shown in FIG. 2 in addition to faceted die surfaces 62 and 64, there are triangular die surfaces 68 and 70 also formed therein. As a result, as shown in FIG. 1, concave indentation 16 has, preferably, at least four faceted surfaces 18*a*, 18*b*, 18*c* and 18*d*.

Figure 12:
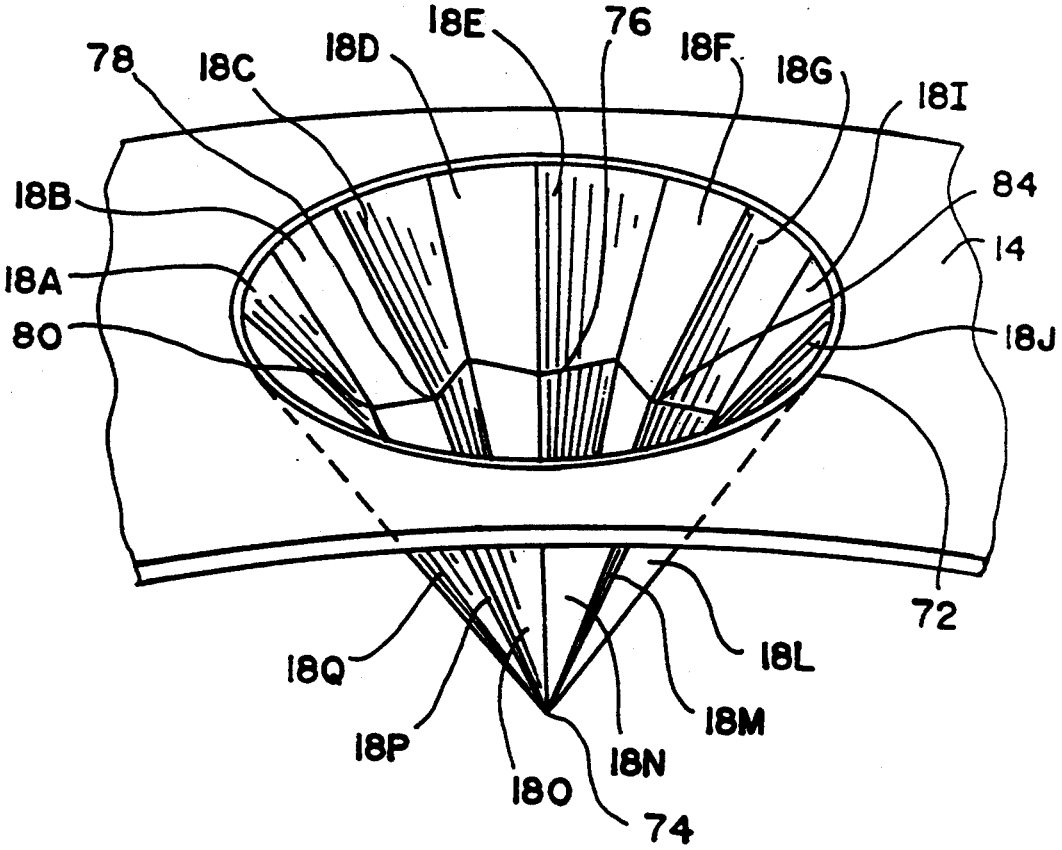
FIG. 12 of the drawing is a front perspective view of an alternative embodiment of the invention showing a round artificial diamond baguette having an engraving line on the angled walls.

As shown in FIG. 12 of the drawings, in an alternative embodiment of the invention, reflective metal surface 14 again contains a concave indentation 16. However, in the embodiment shown concave indentation 16 is round about its periphery 72. Formed within concave indentation 16 are a series of faceted surfaces 18*a* through 18*r*. These faceted surfaces in this embodiment are triangular in shape with the tip of each of the triangularly shaped faceted surfaces converging at the bottom 74 of concave indentation 16. In addition, each of the triangularly shaped faceted surfaces 18*a* through 18*r* is separated from the next triangularly shaped surface by a score line 42*a* through 42*r*. These score lines serve to mark the division between the faceted surfaces which are not smooth and continuous but are rather angled so as to reflect light upwardly. In addition, an additional set of horizontal score lines 76, 78, 80, 82 and 84 is disposed within concave indentation 16 approximately midway between it periphery 72 and its base 74. These horizontal score line further mark the angling of the faceted surfaces 18*a* through 18*r*. As a result, when light enters concave indentation 16 from above, it is reflected numerous times within the concave indentation 16 against the faceted surfaces and back outwardly toward the user. These series of reflections cause the reflected light to be white and to appear to be reflections from a diamond. A pleasing affect is thereby created.

I claim as my invention:

1. A metal jewelry article having one or more artificial diamond baguettes formed therein, said article comprising:

a reflective metal surface having one or more solely concave indentations formed therein, said indentations being formed into the shape of an artificial diamond baguette, said indentations having a plurality of downward depending faceted reflective surfaces formed therein, said faceted reflective surfaces being angled and positioned so as to reflect light in a manner which simulates a diamond, said plurality of faceted reflective surfaces being formed in a substantially uniform rib and groove configuration, said grooves having triangularly shaped end portions formed therein;

said identations having a substantially rectangular exterior periphery.

2. The jewelry article of claim 1 wherein said groves are approximately 0.30 inches in width, 0.138 inches in length and 0.030 inches deep whereby said ribs and grooves reflect light in a manner which simulate a diamond.

3. The jewelry article of claim 1 wherein said triangularly shaped end portions are approximately 0.25 inches in height and 0.60 inches in length along their base.

4. The jewelry article of claim 1 wherein said faceted reflective surfaces comprise a groove having sidewalls angled at approximately 45 degrees to each other.

5. The jewelry article of claim 1 wherein said triangularly shaped end portions are formed at an angle of approximately 45 degrees from said rib.

6. The jewelry article of claim 1 wherein said plurality of faceted surfaces are formed in a substantially uniform rib and groove configuration, each groove being longitudinally bifurcated by a score line.

7. The jewelry article of claim 1 wherein each said triangularly shaped end portions is formed in the shape of a right triangle.

8. The jewelry article of claim 1 wherein said metal jewelry article is constructed of precious metals so that said reflective metal surface reflects light in a manner which simulates a diamond.

9. The jewelry article of claim 1 wherein said article is constructed of precious metal 0.015 inches $\pm 0.01$ in thickness.

10. The jewelry article of claim 1 wherein said plurality of faceted reflective surfaces comprises an exterior rectangle, an interior rectangle and a centered longitudinal score line; arranged so as to reflect light in a manner simulating a diamond.

11. The jewelry articles of claim 1 wherein said substantially concave indentation is a tapered rectangle whereby the distal end of said indentation is wider than the proximal end thereof so as to present the illusion of a tapered diamond.

12. The jewelry article of claim 1 wherein a plurality of said artificial diamond baguettes are disposed in a substantially linear array on said article.

* * * * *